US011700987B2

(12) United States Patent
Kang

(10) Patent No.: US 11,700,987 B2
(45) Date of Patent: Jul. 18, 2023

(54) ROBOT CLEANER AND ROBOT SYSTEM HAVING THE SAME

(71) Applicant: LG ELECTRONICS INC., Seoul (KR)

(72) Inventor: Jungwook Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 406 days.

(21) Appl. No.: 16/943,034

(22) Filed: Jul. 30, 2020

(65) Prior Publication Data

US 2021/0030239 A1 Feb. 4, 2021

(30) Foreign Application Priority Data

Jul. 31, 2019 (KR) ..... 10-2019-0093475

(51) Int. Cl.
*A47L 11/282* (2006.01)
*A47L 11/40* (2006.01)

(52) U.S. Cl.
CPC ..... *A47L 11/4011* (2013.01); *A47L 11/282* (2013.01); *A47L 11/4008* (2013.01); *A47L 11/4038* (2013.01); *A47L 11/4066* (2013.01); *A47L 11/4069* (2013.01); *A47L 11/4083* (2013.01); *A47L 11/4088* (2013.01)

(58) Field of Classification Search
CPC ..... A47L 11/03; A47L 11/10; A47L 11/14; A47L 11/145; A47L 11/28; A47L 11/282; A47L 11/29; A47L 11/292; A47L 11/302; A47L 11/4011; A47L 11/4016; A47L 11/4019; A47L 11/4022; A47L 11/4038; A47L 11/4066; A47L 11/4069; A47L 11/408; A47L 11/4083; A47L 11/4088
See application file for complete search history.

(56) References Cited

FOREIGN PATENT DOCUMENTS

KR 940008652 A * 5/1994

OTHER PUBLICATIONS

Machine Translation of Jung, KR940008652A, May 1994. (Year: 1994).*

* cited by examiner

*Primary Examiner* — David G Cormier
(74) *Attorney, Agent, or Firm* — Birch, Stewart, Kolasch & Birch, LLP

(57) ABSTRACT

A robot cleaner includes a main body, a water tank including a turbidity sensor and a water level sensor, and a pair of rotary mops configured to move the main body while rotating in contact with a floor. A drive motor rotates the pair of rotary mops and a nozzle supplies water from the water tank to the rotary mop. A rotary mop controller varies an output current of the drive motor based on signals from the water tank sensors. A controller determines whether the water tank is contaminated based on the output current of the drive motor received from the rotary mop controller.

20 Claims, 10 Drawing Sheets

ROBOT CLEANER AND ROBOT SYSTEM HAVING THE SAME

FIELD

The present disclosure relates to a robot cleaner and a method for controlling the robot cleaner, and more particularly, to a control method of an artificial intelligence robot cleaner using a rotary mop.

BACKGROUND

Recently, the use of robots in the home is gradually increasing. A representative example of such a home robot is a cleaning robot. The cleaning robot is a moving robot that travels on a certain zone by itself, and sucks foreign matter such as dust accumulated on the floor to clean a cleaning space automatically, or can be moved by using a rotary mop and perform cleaning by using the rotary mop to wipe the floor. In addition, is also possible to mop the floor by supplying water to the rotary mop.

However, if the water supplied to the rotary mop is not properly adjusted, there is a problem in that the floor cannot be cleaned appropriately, as if excessive water is remained on the floor to be cleaned or the floor is wiped with a dry mop. In the case of Korean Publication Patent No. 1020040052094, a cleaning robot capable of performing water cleaning, while including a mop roller having a mop cloth on its outer circumferential surface to wipe off the steam sprayed on the floor with dust, is disclosed. Such a cleaning robot sprays steam on the surface of the cleaning floor for wet cleaning, and has a cloth for mop to wipe off the sprayed steam and dust. In addition, Korean Publication Patent No. 20140146702 discloses a robot cleaner for determining whether water can be accommodated inside a robot cleaner capable of performing wet cleaning, and a control method thereof.

However, there is a problem of cost and equipment since a separate module is required to detect the state of the water tank of the cleaner having the mop and transmit the detection information to the main module.

SUMMARY

An object of the present disclosure is to provide the control method of the robot cleaner that can detect the water supply abnormality and the water turbidity of the water tank providing water to the rotary mop, and alarm the user by having a variety of sensors in the water tank.

The other object of the present disclosure is to provide the control method of the robot cleaner that can alarm the user of a detection result of sensors in the water tank by controlling the output current of the motor of the rotary mop of the robot cleaner.

Another object of the present disclosure is to provide the control method of the robot cleaner that can simultaneously read whether the water supply of the current water tank is abnormal or not and whether the water is turbid according to a change in the pattern of the output current of the motor of the rotary mop.

The present disclosure is not limited to the problems mentioned above, and other problems not mentioned will be clearly understood by those skilled in the art from the following description.

In an aspect, there is provided a robot cleaner including: a main body configured to form an outer shape; a water tank configured to contain water and include a plurality of sensors including a turbidity sensor and a water level sensor; a pair of rotary mops configured to move the main body while rotating in contact with a floor; a drive motor configured to rotate the pair of rotary mops; a nozzle configured to supply water of the water tank to the rotary mop; a rotary mop controller configured to control the nozzle and the drive motor, and vary an output current of the drive motor according to detection signals from the plurality of sensors of the water tank; and a controller configured to determine whether the water tank is contaminated by receiving the output current of the drive motor from the rotary mop controller when the pair of rotary mops rotate.

The water tank is provided with the turbidity sensor detecting the turbidity of the water in the water tank on the wall surface.

The water tank is provided with the water level sensor detecting the water level of the water in the water tank on the wall surface.

The rotary mop controller periodically receives the detection signal from the turbidity sensor and the water level sensor, and changes the output current of the drive motor according to the detection signal.

The rotary mop controller determines that the water supply is abnormal and changes the output current of the drive motor to a first value when the detection signal of the water level sensor does not change compared to the detection signal of the previous period.

The rotary mop controller determines that the water in the water tank is contaminated and changes the output current of the drive motor to a second value when the detection signal of the turbidity sensor is greater than or equal to a threshold value.

The first value and the second value are different from each other.

The first value and the second value are changed to have different pulse widths.

The controller periodically receives the output current of the drive motor from the rotary mop controller and analyzes the received waveform of the output current to determine whether the water supply is abnormal, or the water tank is contaminated.

The turbidity sensor includes a transmitter formed on an outer wall of the water tank, and a receiver formed on an outer wall of the water tank, and the receiver detects the turbidity of water in the water tank from the reception or scattering value of an ultrasonic signal from the transmitter.

The water level sensor includes a light emitter formed on the outer wall of the water tank, and a light receiver facing the light emitter and formed on the outer wall of the water tank.

The receiver and the light receiver are formed of one module and outputs the detection signal to the rotary mop controller.

In another aspect, there is provided a robot system including: a robot cleaner configured to perform wet cleaning in a cleaning area; a server configured to transmit and receive the robot cleaner and perform control of the robot cleaner; and a user terminal configured to perform control of the robot cleaner by activating an application for interworking with the robot cleaner and the server, and controlling the robot cleaner, wherein the robot cleaner comprises; a main body configured to form an outer shape; a water tank configured to contain water and include a plurality of sensors including a turbidity sensor and a water level sensor, a pair of rotary mops configured to move the main body while rotating in contact with a floor; a drive motor configured to rotate the pair of rotary mops; a nozzle configured to supply water of the water tank to the rotary mop; a rotary mop controller configured to control the nozzle and the drive motor, and vary an output current of the drive motor according to detection signals from the plurality of sensors of the water tank; and a controller configured to determine whether the water tank is contaminated by receiving the output current of the drive motor from the rotary mop controller when the pair of rotary mops rotate.

The water tank includes the turbidity sensor detecting the turbidity of the water in the water tank on the wall surface, and the water level sensor detecting the water level of the water in the water tank.

The rotary mop controller periodically receives the detection signal from the turbidity sensor and the water level sensor and changes the output current of the drive motor according to the detection signal.

The rotary mop controller determines that the water supply is abnormal and changes the output current of the drive motor to a first value when the detection signal of the water level sensor does not change compared to the detection signal of the previous period, and the rotary mop controller determines that the water in the water tank is contaminated and changes the output current of the drive motor to a second value when the detection signal of the turbidity sensor is greater than or equal to a threshold value.

The first value and the second value are changed to have different pulse widths.

The controller periodically receives the output current of the drive motor from the rotary mop controller, analyzes the received waveform of the output current to determine whether the water supply is abnormal or the water tank is contaminated and transmits a determined result to the user terminal.

The turbidity sensor includes a transmitter formed on an outer wall of the water tank, and a receiver formed on an outer wall of the water tank, and the receiver detects the turbidity of water in the water tank from the reception or scattering value of an ultrasonic signal from the transmitter.

The water level sensor includes a light emitter formed on the outer wall of the water tank, and a light receiver facing the light emitter and formed on the outer wall of the water tank.

According to the robot cleaner of the present disclosure, there are one or more of the following effects.

The present disclosure is equipped with a variety of simple sensors in the water tank, it is possible to detect the water supply abnormality and the water turbidity of the water tank providing water to the rotary.

In addition, by controlling the output current of the motor of the rotary mop of the robot cleaner without a separate sensing signal processing module, a detection result for the sensors of the water tank can be alarmed to the user, thereby reducing cost and operation.

In addition, according to the change in the pattern of the output current of the motor of the rotary mop, it is possible to simultaneously read the water supply abnormality and the water turbidity, thereby inducing water replacement from the user.

The effects of the present disclosure are not limited to the effects mentioned above, and other effects not mentioned will be clearly understood by those skilled in the art from the description of the claims.

DESCRIPTION OF EXEMPLARY EMBODIMENTS

Figure 1:
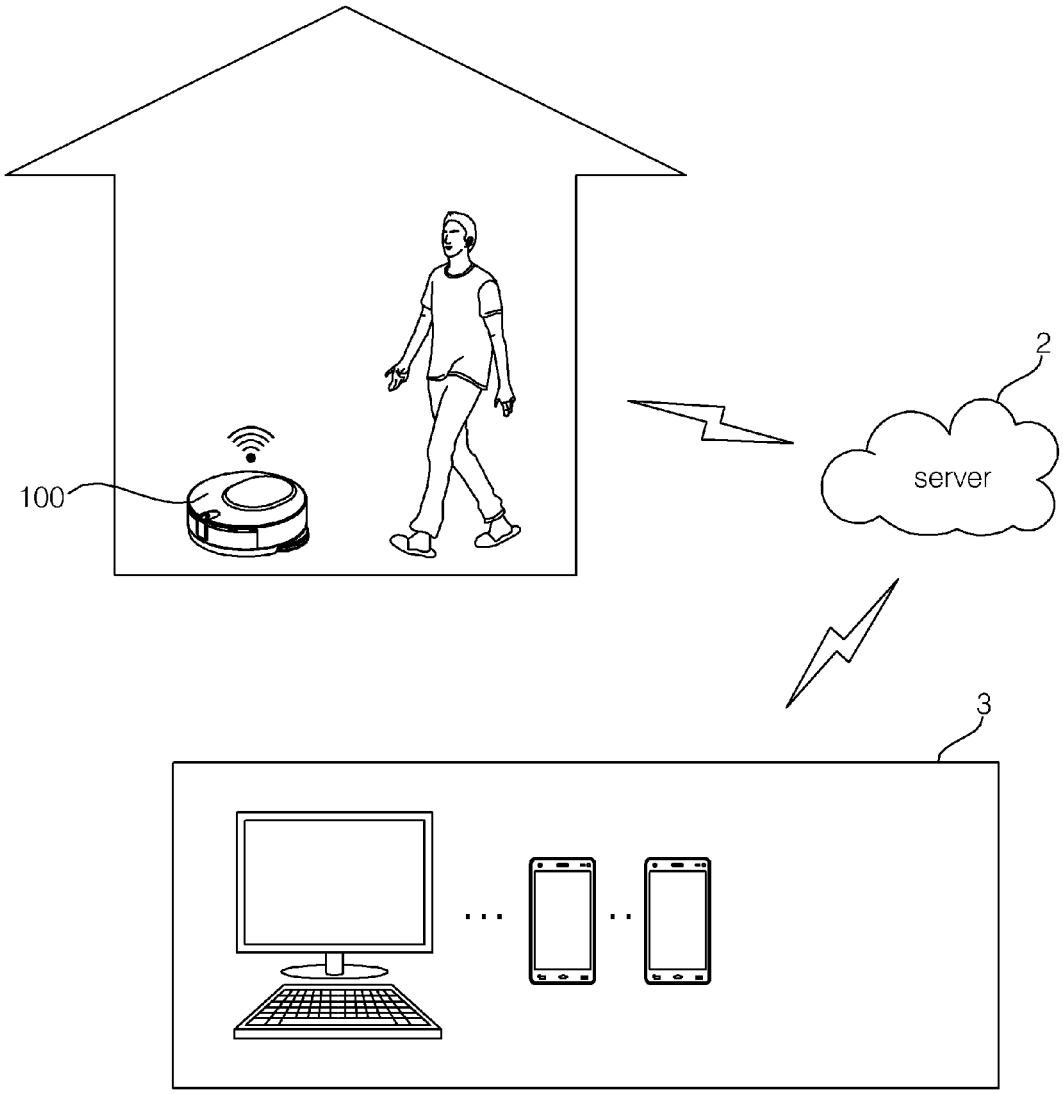
FIG. 1 is a constitutional view of a robot cleaner system including a robot cleaner according to an embodiment of the present disclosure.

Expressions referring to directions such as "front (F)/rear (R)/left (Le)/right (Ri)/upper (U)/lower (D)" mentioned below are defined based on the illustrations in the drawings, but this is merely given to describe the present disclosure for clear understanding thereof, and it goes without saying that the respective directions may be defined differently depending on where the reference is placed.

The use of terms in front of which adjectives such as "first" and "second" are used in the description of constituent elements mentioned below is intended only to avoid confusion of the constituent elements, and is unrelated to the order, importance, or relationship between the constituent elements. For example, an embodiment including only a second component but lacking a first component is also feasible.

The thickness or size of each constituent element shown in the drawings may be exaggerated, omitted, or schematically drawn for the convenience and clarity of explanation. The size or area of each constituent element may not utterly reflect the actual size or area thereof.

Angles or directions used to describe the structure of the present disclosure are based on those shown in the drawings. Unless a reference point with respect to an angle or positional relationship in the structure of the present disclosure is clearly described in the specification, the related drawings may be referred to.

FIG. 1 is a constitutional view of an artificial-intelligence robot system according to an embodiment of the present disclosure.

Referring to FIG. 1, the robot system according to the embodiment of the present disclosure may include at least one robot cleaner 100 for providing a service in a prescribed place such as a house. For example, the robot system may include a home robot cleaner 100, which interacts with a user at home and provides various forms of entertainment to the user. In addition, the home robot cleaner 100 may perform online shopping or online ordering and may provide a payment service in accordance with the user request.

Preferably, the robot system according to the embodiment of the present disclosure may include a plurality of artificial-intelligence robot cleaners 100 and a server 2 capable of managing and controlling the plurality of artificial-intelligence robot cleaners 100. The server 2 may monitor and control the status of the plurality of robots 1 from a remote place, and the robot system may provide a service more effectively using the plurality of robots 1.

The plurality of robot cleaners 100 and the server 2 may include a communication module (not shown), which supports one or more communication standards, so as to communicate with each other. In addition, the plurality of robot cleaners 100 and the server 2 may communicate with a PC, a mobile terminal, and another external server 2.

For example, the plurality of robot cleaners 100 and the server 2 may implement wireless communication using a wireless communication technology such as IEEE 802.11 WLAN, IEEE 802.15 WPAN, UWB, Wi-Fi, ZigBee, Z-wave, Bluetooth, or the like. The robot cleaners 100 may be configured differently depending on the type of communication of other devices, with which the robot cleaners 100 intend to communicate, or the server 2.

In particular, the plurality of robot cleaners 100 may communicate with another robot cleaner 100 and/or the server 2 in a wireless manner over a 5G network. When the robot cleaners 100 implement wireless communication over a 5G network, real-time response and real-time control are possible.

The user may confirm information on the robot cleaners 100 in the robot system through a user terminal 3 such as a PC or a mobile terminal.

The server 2 may be implemented as a cloud server 2, and the cloud server 2 may be interlocked with the robot cleaners 100 so as to monitor and control the robot cleaners 100 and remotely provide various solutions and contents.

The server 2 may store and manage information received from the robot cleaners 100 and other devices. The server 2 may be a server 2 that is provided by a manufacturer of the robot cleaners 100 or a company entrusted with the service by the manufacturer. The server 2 may be a control server 2 that manages and controls the robot cleaners 100.

The server 2 may control the robot cleaners 100 collectively and uniformly or may control the robot cleaners 100 individually. Meanwhile, the server 2 may be implemented as multiple servers to which pieces of information and functions are dispersed or may be implemented as a single integrated server.

The robot cleaners 100 and the server 2 may include a communication module (not shown), which supports one or more communication standards, for communication therebetween.

The robot cleaners 100 may transmit data related to space, objects, and usage to the server 2.

Here, the data related to space and objects may be data related to recognition of space and objects that is recognized by the robot cleaners 100, or may be image data on space and objects that is acquired by an image acquisition unit.

Depending on the embodiment, the robot cleaners 100 and the server 2 may include artificial neural networks (ANN) in the form of software or hardware that has learned to recognize at least one of a user, a voice, properties of space, or properties of an object such as an obstacle.

According to the embodiment of the present disclosure, the robot cleaners 100 and the server 2 may include a deep neural network (DNN), such as a convolutional neural network (CNN), a recurrent neural network (RNN), or a deep belief network (DBN), which has been trained through deep learning. For example, the controller 140 of each robot cleaner 100 may be equipped with a deep neural network (DNN) structure such as a convolutional neural network (CNN).

The server 2 may train the deep neural network (DNN) based on data received from the robot cleaners 100 or data input by the user, and thereafter may transmit the updated data on the deep neural network (DNN) structure to the robots 1. Accordingly, the artificial-intelligence deep neural network (DNN) structure provided in the robot cleaners 100 may be updated.

Data related to usage may be data acquired in accordance with use of the robot cleaners 100. Data on use history or a sensing signal acquired through a sensor unit 110 may correspond to the data related to usage.

The trained deep neural network (DNN) structure may receive input data for recognition, may recognize properties of people, objects, and space included in the input data, and may output the result of recognition.

In addition, the trained deep neural network (DNN) structure may receive input data for recognition, may analyze and learn data related to usage of the robot cleaners 100, and may recognize a usage pattern and a usage environment.

Meanwhile, the data related to space, objects, and usage may be transmitted to the server 2 via a communication unit.

The server 2 may train the deep neural network (DNN) based on the received data, and thereafter may transmit the updated data on the deep neural network (DNN) structure to the artificial-intelligence robot cleaners 100 so that the robots update the deep neural network (DNN) structure.

Accordingly, the robot cleaners 100 may continually become smarter, and may provide a user experience (UX) that evolves as the robot cleaners 100 are used.

Meanwhile, the server 2 can provide information about the control and the current state of the robot cleaner 100 to the user terminal and can generate and distribute an application for controlling the robot cleaner 100.

Such an application may be an application for a PC applied as the user terminal 3 or an application for a smartphone.

For example, it may be an application for controlling a smart home appliance, such as a SmartThinQ application, which is an application that can simultaneously control and manage various electronic products of the present applicant.

Figure 2:
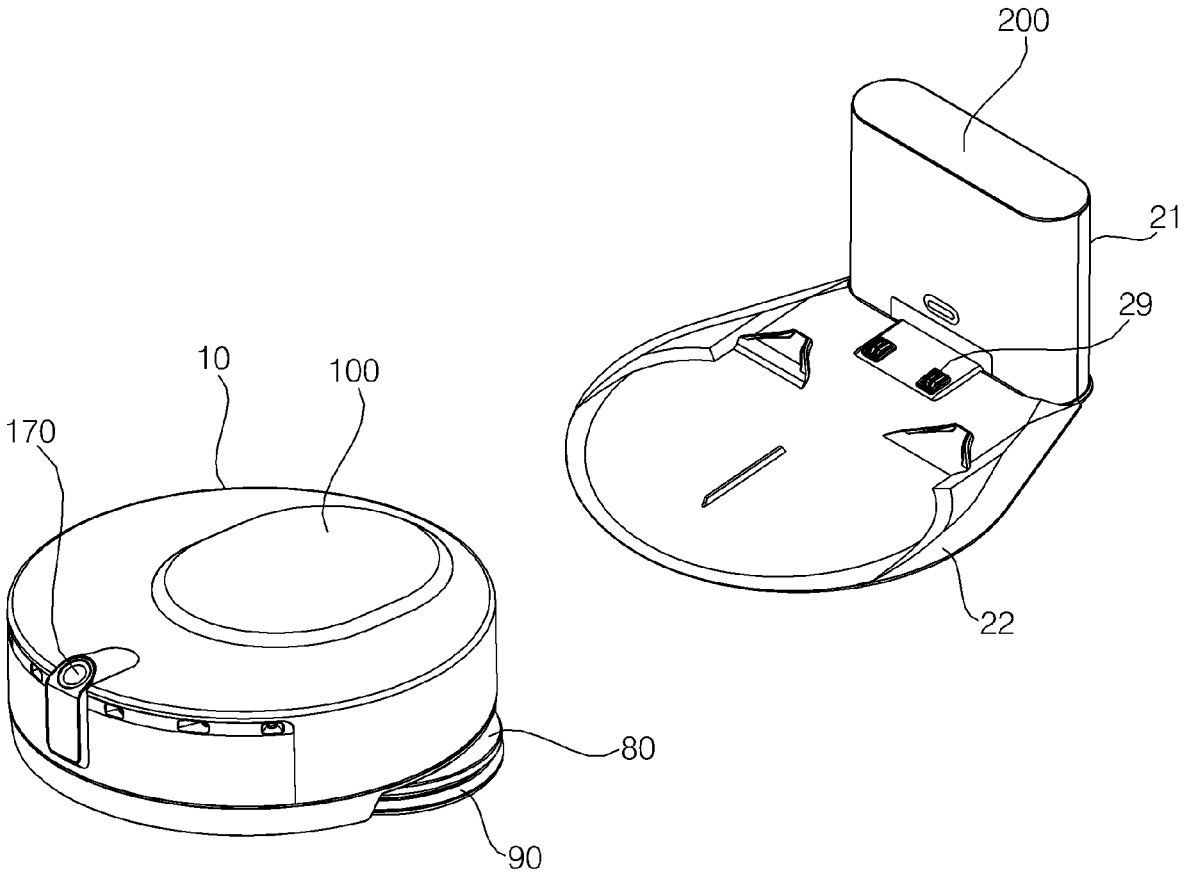
FIG. 2 is a perspective view of a robot cleaner according to an embodiment of the present disclosure.
Figure 3:
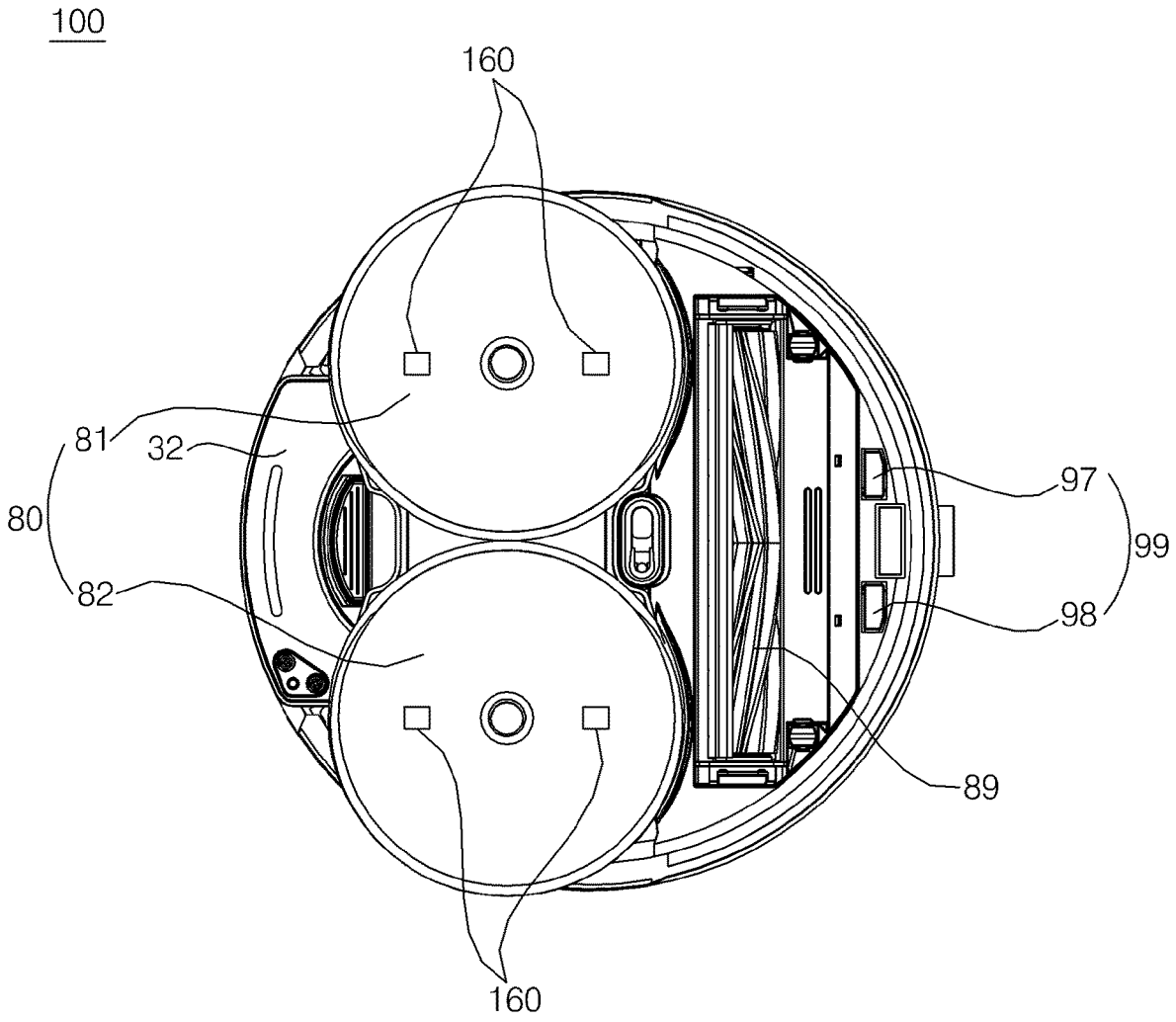
FIG. 3 is a bottom view of the robot cleaner.
Figure 4:
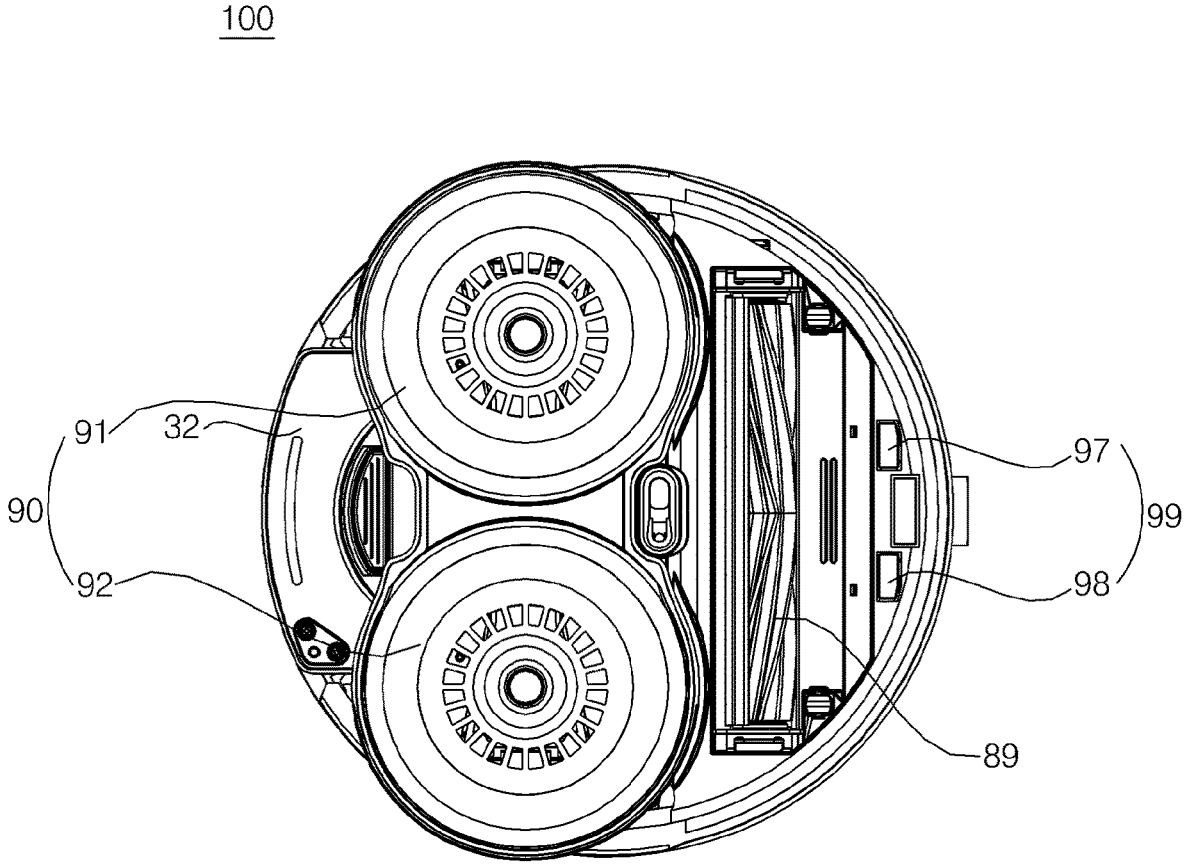
FIG. 4 is another state diagram of the bottom view of the robot cleaner.

FIG. 2 is a perspective view of a robot cleaner according to an embodiment of the present disclosure, FIG. 3 is a bottom view of the robot cleaner of FIG. 2, and FIG. 4 is another state diagram of the bottom view of the robot cleaner of FIG. 3.

Referring to FIGS. 2 to 4, the configuration of the robot cleaner 100 in motion by the rotation of the rotary mop according to the present embodiment will be described briefly.

The robot cleaner 100 according to an embodiment of the present disclosure moves in a cleaning area and removes foreign matter on the floor during traveling.

In addition, the robot cleaner 100 stores the charging power supplied from a charging station 200 in a battery (not shown) and travels the cleaning area.

The robot cleaner 100 includes a main body 10 performing a designated operation, an obstacle detecting unit (not shown) which is disposed in the front surface of the main body 10 and detects an obstacle, and an image acquisition unit 170 photographing a 360 degree image. The main body 10 includes a casing (not shown) which forms an outer shape and forms a space in which components constituting the main body 10 are accommodated, a rotary mop 80 which is rotatably provided, a roller 89 which assists movement of the main body 10 and the cleaning, and a charging terminal 99 to which charging power is supplied from the charging station 2.

The rotary mop 80 is disposed in the casing and formed toward the floor surface and the mop cloth is configured to be detachable.

The rotary mop 80 includes a first rotating plate 81 and a second rotating plate 82 to allow the body 10 to move along the floor of the zone through rotation.

When rotating the rotary mop 80 used in the robot cleaner 100 of this embodiment a slip occurs that the robot cleaner 100 does not move compared to the actual rotation of the rotary mop 80. The rotary mop 80 may include a rolling mop driven by a rotation axis parallel to the floor, or a spin mop driven by a rotation axis substantially perpendicular to the floor.

In the case where the rotatable mop 80 includes the spin mop, the output current value of the drive motor that rotates the spin mop may vary according to the water content, which is the ratio of the water containing the spin mop. The water content refers to the degree to which the spin mop contains water, and the state having a water content of '0' means a state in which no water is contained in the spin mop. The water content according to this embodiment may be set to a ratio including water according to the weight of the cleaning cloth. The spin mop may contain water having the same weight as that of the cleaning cloth, or it may contain water in excess of the weight of the cleaning cloth.

The higher the water content is in the rotary mop 80, the more the frictional force with the bottom surface is generated by the influence of water, thereby reducing the rotational speed.

Decreasing the rotation speed of the drive motor 38 means that the torque of the drive motor 38 is increased, and accordingly, the output current of the drive motor 38 that rotates the spin mop is increased.

That is, when the water content increases, a relationship is established in which the output current of the drive motor 38 that rotates the spin mop increases due to the increased frictional force.

In addition, the controller 150 can transmit various information by varying the output current of the drive motor 38 for a predetermined time. This will be described later.

The robot cleaner 100 according to the present embodiment may further include a water tank 32 which is disposed inside the main body 10 and stores water, a pump 34 for supplying water stored in the water tank 32 to the rotary mop 80, and a connection hose for forming a connection flow path connecting the pump 34 and the water tank 32 or connecting the pump 34 and the rotary mop 80.

The robot vacuum cleaner 100 according to the present embodiment includes a pair of rotary mops 80 and moves by rotating the pair of rotary mops 80.

The main body 10 travels forward, backward, left, and right as the first rotating plate 81 and the second rotating plate 82 of the rotary mop 80 rotate about a rotating shaft. In addition, as the first and second rotating plates 81 and 82 rotate, the main body 10 performs wet cleaning as foreign matter on the floor surface is removed by the attached mop cloth.

The main body 10 may include a driving unit (not shown) for driving the first rotating plate 81 and the second rotating plate 82. The driving unit may include at least one drive motor 38.

The upper surface of the main body 10 may be provided with a control panel including an operation unit (not shown) that receives various commands for controlling the robot cleaner 100 from a user.

In addition, the image acquisition unit 170 is disposed in the front or upper surface of the main body 10.

The image acquisition unit 170 captures an image of an indoor area.

On the basis of the image captured by the image acquisition unit 170, it is possible to detect obstacles around the main body as well as to monitor the indoor area.

The image acquisition unit 170 may be disposed toward the front and upper direction at a certain angle to photograph the front and the upper side of the moving robot. The image acquisition unit 170 may further include a separate camera for photographing the front. The image acquisition unit 170 may be disposed above the main body 10 to face a ceiling, and in some cases, a plurality of cameras may be provided. In addition, the image acquisition unit 170 may be separately provided with a camera for photographing the floor surface.

The robot cleaner 100 may further include position obtaining means (not shown) for obtaining current position information. The robot cleaner 100 may include GPS and UWB to determine the current position. In addition, the robot cleaner 100 may determine the current position by using the image.

The main body 10 includes a rechargeable battery (not shown), and a charging terminal 99 of the battery may be connected to a commercial power source (e.g., a power outlet in a home) or the main body 10 may be docked to the charging station 200 connected to the commercial power source, so that the charging terminal may be electrically connected to the commercial power source through contact with a terminal 29 of the charging station and the battery may be charged by the charging power supplied to the main body 10.

The electric components constituting the robot cleaner 100 may be supplied with power from a battery, and thus, the robot cleaner 100 may automatically move in a state in which the robot cleaner 100 is electrically separated from commercial power.

Hereinafter, it will be described on the assumption that the robot cleaner 100 is a wet cleaning moving robot. However, the robot cleaner 100 is not limited thereto and it should be noted that any robot that detects sound while autonomously traveling a zone can be applicable.

FIG. 4 is a diagram illustrating an embodiment in which a mop cloth is attached to the moving robot of FIG. 2.

As shown in FIG. 4, the rotary mop 80 includes a first rotating plate 81 and a second rotating plate 82.

The first rotating plate 81 and the second rotating plate 82 may be provided with attached mop cloth 90 (91, 92), respectively.

The rotary mop 80 is configured such that mop cloth 90 (91, 92) can be detachable. The rotary mop 80 may have a mounting member for attachment of the mop cloth 90 (91, 92) provided in the first rotating plate 81 and the second rotating plate 82, respectively. For example, the rotary mop 80 may be provided with a Velcro, a fitting member, or the like so that the mop cloth 90 (91, 92) can be attached and fixed. In addition, the rotary mop 80 may further include a mop cloth frame (not shown) as a separate auxiliary means for fixing the mop cloth 90 (91, 92) to the first rotating plate 81 and the second rotating plate 82.

The mop cloth 90 absorbs water to remove foreign matter through friction with the floor surface. The mop cloth 90 is preferably a material such as cotton fabric or cotton blend, but any material containing water in a certain ratio or higher and having a certain density can be used, and the material is not limited.

The mop cloth 90 is formed in a circular shape.

The shape of the mop cloth 90 is not limited to the drawing and may be formed in a quadrangle, polygon, or the like. However, considering the rotational motion of the first and second rotating plates 81 and 82, it is preferable that the first and second rotating plates 81 are configured in a shape that does not interfere with the rotation operation of the first and second rotating plates 81 and 82. In addition, the shape of the mop cloth 90 can be changed into a circular shape by the mop cloth frame provided separately.

The rotary mop 80 is configured such that when the mop cloth 90 is mounted, the mop cloth 90 comes into contact with the floor surface. Considering the thickness of the mop cloth 90, the rotary mop 80 is configured to change a separation distance between a casing and the first and second rotating plates 81 and 82 according to the thickness of the mop cloth 90.

The rotary mop 80 may further include a member adjusting the separation distance between the casing and the rotating plates 81 and 82 so that the cleaning cloth 90 and the bottom surface come into contact, and generating pressure on the first and second rotating plates 81 and 82 toward the bottom surface.

Figure 5:
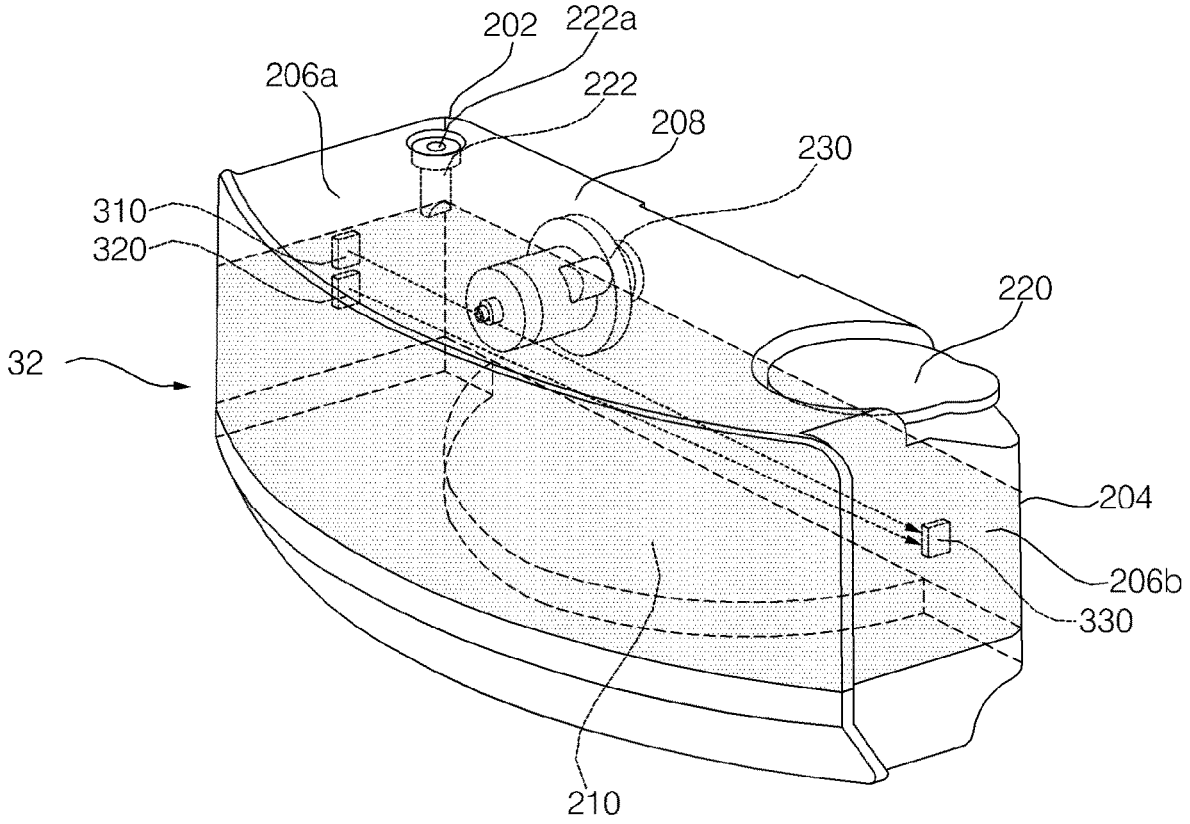
FIG. 5 illustrates a sensor formed in a water tank of the robot cleaner according to an embodiment of the present disclosure.
Figure 6:
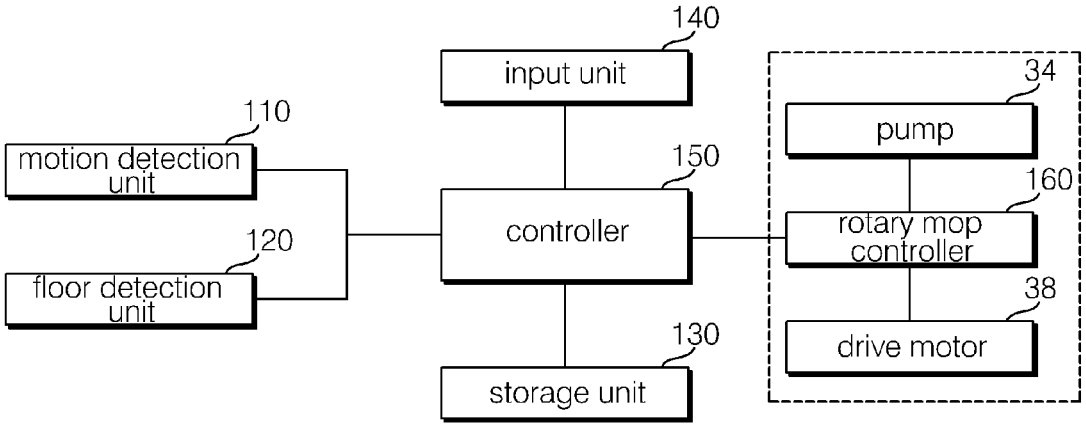
FIG. 6 is a block diagram showing a configuration related to the controller and the controller of the robot cleaner according to an embodiment of the present disclosure.

FIG. 5 illustrates a sensor formed in a water tank of the robot cleaner according to an embodiment of the present disclosure, and FIG. 6 is a block diagram showing a configuration related to the controller and the controller of the robot cleaner according to an embodiment of the present disclosure.

Referring to FIG. 5, the water tank 32 of the robot cleaner 100 according to an embodiment of the present disclosure includes a water tank case 202 forming a space in which water is stored, an opening cover 220 opening and closing an opening (not shown) formed in the upper side of the water tank case 202, (not shown), and a discharge nozzle unit 230 connected to the supply nozzle when the water tank 32 is mounted on the main body 10.

The water tank case 202 has a shape corresponding to the mounting space of the water tank formed in the main body 10. Accordingly, the water tank case 202 may be inserted into or removed from the mounting space formed by the main body 10.

When the water tank 32 is mounted on the main body 10, the water tank case 202 may include a case front face 204 facing the main body 10, both side surface 206 of the case 10 facing the both sides of the body 10, a case upper surface 208, a case lower surface 210 and a case rear surface 212 rearwardly disposed and exposed to the outside.

On the upper side of the water tank case 202, an opening (not shown) that is opened to supply water to the inner space of the water tank case 202 is formed, and the opening cover 220 for opening and closing the opening is disposed in the opening. The opening is formed in the case upper surface 208, and the opening cover 220 is disposed in the case upper surface 208 in which the opening is formed.

On the upper side of the water tank case 202, an air passage 222*a* communicating the inside and the outside of the water tank 32 is formed. The air passage 222*a* may be formed in a separate passage member 222 mounted on the upper side of the water tank case 202.

The air passage 222*a* is formed on the case upper surface 208. When the water tank 32 is mounted on the water tank housing, the case upper surface 208 may be spaced apart a predetermined distance from the upper surface of the water tank housing. Therefore, in the state in which the water tank 32 is mounted on the water tank housing, even though the water inside the water tank 32 escapes to the outside of the water tank 32 through the discharge nozzle unit 230, external air may be introduced into the water tank 32 through the air passage 222*a*.

The discharge nozzle unit 230 is disposed on the case front surface 204. The discharge nozzle unit 230 may be disposed in a direction biased to the left or right of the case front surface 204. The discharge nozzle unit 230 according to the present embodiment is disposed biased to the left from the case front surface 204.

A plurality of sensors may be formed in the water tank 32.

The plurality of sensors includes the turbidity sensors 310 and 330 and the water level sensors 320 and 330.

The turbidity sensors 310 and 330 may be disposed on the surface of the water tank 32, and when the wall of the water tank 32 is formed of a light-transmitting material, it may be disposed on the outer wall. For example, it may be disposed on both sides 206*a*, 206*b* of the case facing each other.

In the case of the turbidity sensors 310 and 330 disposed on the outer surface of the water tank 32, the sensor includes a light emitting unit 310 and a light receiving unit 330.

The light emitting unit 310 is a light source that emits light in a specific wavelength range and may include an LED light source.

The light receiving unit 330 may be arranged to be spaced apart from the light emitting unit 310 according to the measurement method of the turbidity sensors 310 and 330.

For example, in the case that the method of measuring the turbidity sensors 310 and 330 is a transmitted light measurement method, this is a method of measuring the amount of light passing through the water tank 32 when a light emitting unit 310 is disposed on one side of the water tank 32 to irradiate light from the light emitting unit 310. Therefore, the light receiving unit 330 is disposed opposite the water tank 32 corresponding to the light emitting unit 310. The degree of attenuation of transmitted light is inversely related to the concentration of suspended matter in the liquid. While this method is simple, the detection signal of the light receiving unit 330 decreases exponentially as the turbidity increases.

Meanwhile, when the measurement method of the turbidity sensors 310 and 330 is a surface scattered light measurement method, it is a method of measuring the scattered light, which is scattered when the light source irradiated to the water tank 32 hits the particles in the water at a 90° to the light source. The intensity of the light can be used in proportion to the concentration of the suspended matter in the liquid.

In contrast, when the turbidity sensors 310 and 330 are measured by a 4-beam measurement method, they are composed of two light sources and two detectors. A light emitting unit and a light receiving unit are disposed around the water tank 32 at an interval of 90°, the first light emitting unit is turned on, the light transmitted from the second light receiving unit is measured by scattered light in the first light receiving unit, and then the second light emitting unit is turned on and the light transmitted from the first light receiving unit is detected by alternately scattering light from the second light receiving unit. As described above, turbidity is measured by measuring in the same way as transmitted scattered light and obtaining the average of the signals measured in two phases.

The turbidity sensors 310 and 330 of the present disclosure can be freely applied according to the method selected from the above three types, but the light receiving unit 330 may be integrally configured to be able to be driven together with other sensors.

Meanwhile, when the water level sensors 320 and 330 are disposed in the water tank 32, the water level sensors 320 and 330 may be contact or non-contact level sensors, but in the case of the present disclosure, they may be non-contact level sensors.

As the non-contact level sensor, an ultrasonic level sensor can be mainly used, and as the method of continuously measuring a liquid surface for measuring the level, an ultrasonic level sensor is used to detect the level by using the ultrasonic pulses. It may include a transmitting unit 320 for emitting ultrasonic pulses and a receiving unit 330 disposed opposite the transmitting unit 320 to receive the emitted ultrasonic waves.

The transmitting unit 320 and the receiving unit 330 may be arranged to face each other on the outer surface 206 of the water tank 32 as shown in FIG. 5, the receiving unit 330 of the water level sensors 320 and the light receiving units 330 of the turbidity sensor 310 and 330 may be formed as one module.

As described above, the light receiving unit 330 of the turbidity sensors 310 and 330 and the receiving unit 330 of the water level sensors 320 and 330 convert the received light or ultrasonic wave into an electric signal, and transmit the electric signal to the rotating mop controller 160 as a detection signal.

The detection signal can be transmitted wirelessly or by wire.

Meanwhile, as shown in FIG. 6, the robot cleaner 100 according to this embodiment further includes a motion detection unit 110 that detects the motion of the robot cleaner 100 according to the reference motion of the main body 10, when the rotary mop 80 rotates. The motion detection unit 110 may further include a gyro sensor detecting the rotational speed of the robot 10 or an acceleration sensor detecting an acceleration value of the robot cleaner 100. In addition, the motion detection unit 110 may use an encoder (not shown) that detects the moving distance of the robot cleaner 100.

The robot cleaner 100 according to the present embodiment further includes a rotary mop controller 160 providing power to the drive motor 38 that rotates and controls the rotary mop 80, reading the output current of the drive motor 38 and transmitting it to the controller 150.

The rotation mop controller 160 may be formed of a separate chip in which simple logic is implemented and may be disposed in a rotary mop module including a drive motor 38, a nozzle and a pump 34.

The rotary mop controller 160 transmits a current for rotating the drive motor 38 according to the start signal of the controller 150 and reads the output current of the drive motor 38 according to a set period. This is transmitted to the controller 150.

The rotary mop controller 160 reads the sensing information from a plurality of sensors formed in the water tank 32 and changes the output current according to the sensing information to transmit it to the controller 150.

Specifically, the turbidity sensors 310 and 330 and the water level sensors 320 and 330 may be included in the water tank 32, and the turbidity sensors 310 and 330 and the water level sensors 320 and 330 may be periodically detect the water level and turbidity of the tank 32 and transmit to the rotary mop controller 160.

The rotary mop controller 160 receives the water level detection signal and the turbidity detection signal and determines whether there is an abnormality in water supply and whether the water in the water tank 32 is contaminated.

The rotation mop controller 160 changes the pattern of the output current of the drive motor 38 according to the determination result and transmits it to the controller 150.

The controller 150 receives the output current from the rotary mop controller 160, analyzes it, and determines the current water supply state of the nozzle and whether the water tank 32 is turbid.

That is, the controller 150 may determine the water supply state of the robot cleaner 100 and whether the water in the water tank 32 is contaminated according to information on the output current of the drive motor 38, and may alarm the user.

Specifically, the controller 150 analyzes the waveform of the received output current, and determines whether there is an error in water supply according to the corresponding waveform, whether there is contamination of water in the water tank 32, or whether it is a normal operation.

At this time, the controller 150 may determine the corresponding error by reading the pulse width of the current waveform by changing the pulse width of the current waveform according to each error.

The data for the pulse width corresponding to each error may be stored in the storage unit 130 in the form of a look-up table but is not limited thereto.

The controller 150 may alert the user's attention by alarming the user terminal 3 or the like about the error.

Meanwhile, the robot cleaner 100 may further include a floor detection unit including a cliff sensor that detects the presence of a cliff on the floor in the cleaning area. The cliff sensor according to the present embodiment may be disposed in the front portion of the robot cleaner 100. In addition, the cliff sensor according to the present embodiment may be disposed on one side of the bumper.

The controller 150 may determine the material of the floor based on the amount of reflected light received from the light receiving element by reflecting light emitted from the light emitting element when the cliff sensor is included, but is not limited thereto.

The robot cleaner 100 according to the present embodiment reads the output current value of the drive motor 38 and adds only simple logic to determine whether the water tank 32 of the current period is contaminated with water and the water injection error of the nozzle.

Each data value for the output current value is set in advance and can be shared by the rotary mop controller 160 and the controller 150.

The robot cleaner 100 according to the present embodiment may further include an input unit 140 for inputting a user's command. The user may set the driving method of the robot cleaner 100 or the operation of the rotary mop 80 through the input unit 140.

In addition, the robot cleaner 100 may further include a communication unit, and may provide an alarm or information according to the determination result of the controller 150 to the server 2 or the user terminal 3 through the communication unit.

The robot cleaner 100 according to the present exemplary embodiment includes a pair of rotary mops 80 and rotates and moves the pair of rotary mops 80. The robot cleaner 100 may control the travelling of the robot cleaner 100 by varying the rotational direction or rotational speed of each of the pair of rotary mops 80.

The straight movement of the robot cleaner 100 may be moved by rotating each of the pair of rotary mops 80 in opposite directions. In this case, the rotational speed of each of the pair of rotary mops 80 is the same, but the rotational direction is different. The robot cleaner 100 may move forward or backward by changing the rotational direction of both the rotary mop 80.

In addition, the robot cleaner 100 may rotate each of the pair of rotary mops 80 by rotating in the same direction. The robot cleaner 100 may rotate in place by varying the rotational speed of each of the pair of rotary mops 80, or may perform a round rotation moving in a curve. By varying the rotational speed ratio of each of the pair of rotary mops 80 of the robot cleaner 100, the radius of the round rotation can be adjusted.

Hereinafter, a method of controlling the robot cleaner according to the present embodiment will be described with reference to FIGS. 7 to 10.

Figure 7:
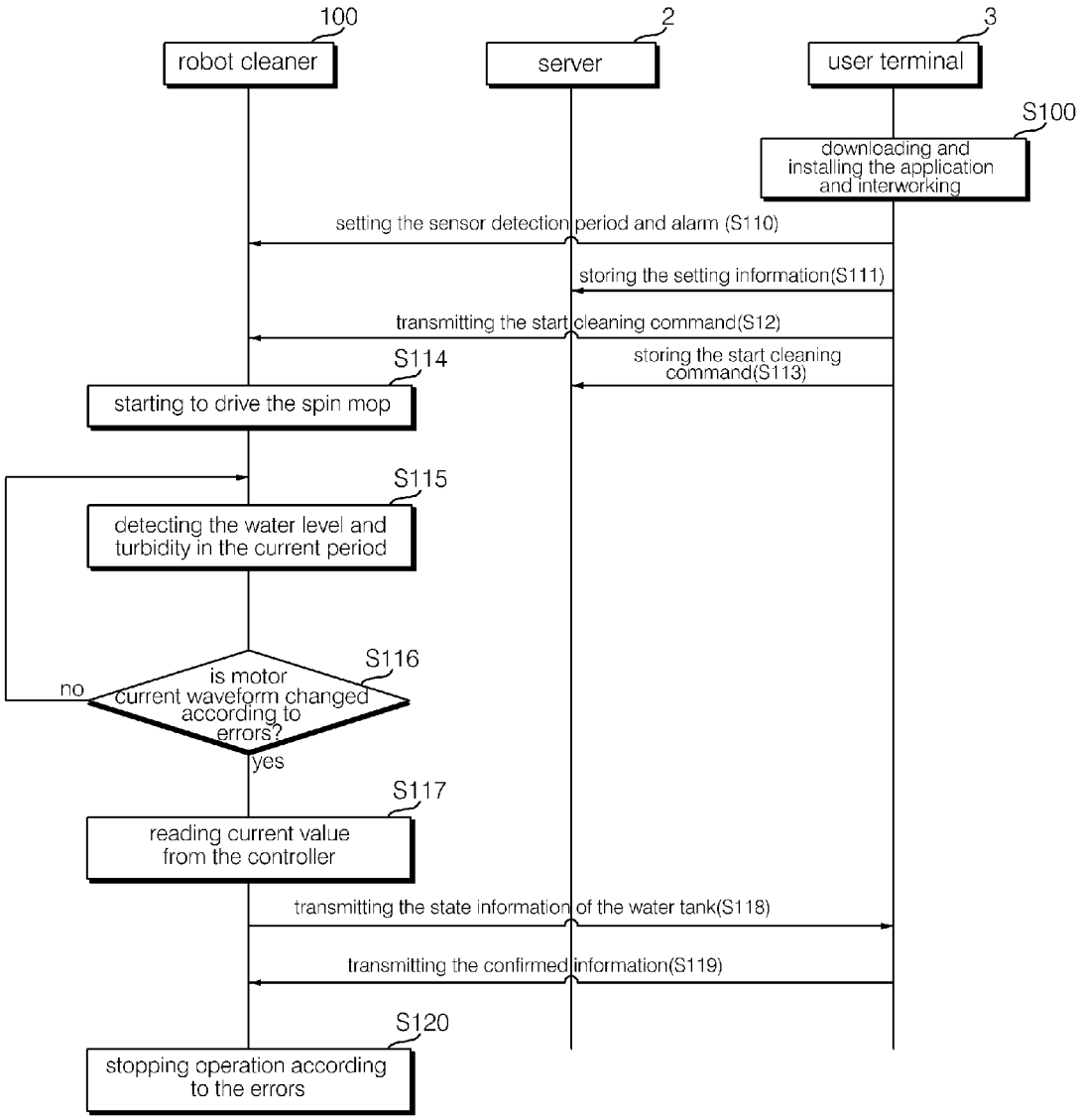
FIG. 7 is a flow chart showing the overall operation of the robot cleaner system of the present disclosure.

FIG. 7 is a flow chart showing the overall operation of the robot cleaner system of the present disclosure according to FIG. 1.

Referring to FIG. 7, the robot cleaner 100, the server 2, and the user terminal 3 perform wireless communication with each other in a robot system including the robot cleaner 100 according to an embodiment of the present disclosure to control the robot cleaner 100.

First, the server 2 of the robot system produces a user application that can control the robot cleaner 100 and holds it in a state that can be distributed online.

The user terminal 3 downloads the user application from online and installs it (S100).

By executing the application for the user, membership and the robot cleaner 100 owned by the user are registered in the application, and the robot cleaner 100 is interlocked with the application.

The user terminal 3 can set various functions for the corresponding robot cleaner 100, and specifically, it may be a setting of a cleaning period, a period setting for checking water supply and turbidity, and a method for alarming the confirmed result according to the period (S110).

The period may be preferably 1 to 10 minutes, and more preferably 1 to 6 minutes.

As an alarm method, a sound alarm and a display alarm can be selected, and an alarm period can also be set.

In addition to displaying the alarm on the application of the user terminal 3 as an alarm method, the robot cleaner 100 itself may also provide the alarm to select a method for arousing the user's attention.

The user terminal 3 transmits data to the server through the application for such setting information (S111), and also transmits data through the wireless communication for the water supply and turbidity checking period and alarm setting information to the robot cleaner 100.

Next, the robot cleaner 100 may receive a cleaning start command from the application of the user terminal 3 (S112). At this time, the start information from the application of the user terminal 3 may be transmitted to the server 2 and stored in the server 2 (S113).

The robot cleaner 100 controls the drive motor 38 and the pump 34 through the rotary mop controller 160 to start cleaning according to the received cleaning start command (S114).

At this time, the controller 150 of the robot cleaner 100 may set an initial value by reading the initial current value of the drive motor 38 that rotates the spin mop. The robot cleaner 100 may transmit information about the initial current value measured to the server 2 through the communication unit, and the server 2 may store it.

The controller 150 transmits the control signal to the rotary mop controller 160 to proceed with cleaning and travelling while rotating the spin mop. Spin mop also performs wet cleaning in a state including a predetermined water content according to water injection from the nozzle driven by the pump 34.

At this time, the controller 150 may proceed with cleaning intensity and travelling by controlling the rotational direction and rotational speed of the spin mop, and perform cleaning while travelling in a predetermined mode according to the cleaning area.

The controller 150 controls the rotary mop controller 160 to transmit the output current of the drive motor 38 of the spin mop every predetermined period. The rotary mop controller 160 may read the output current of the drive motor 38 and periodically transmit it to the controller 150, and supply power to the drive motor 38 to drive it.

At this time, the rotary mop controller 160 periodically receives the detection signals from the water level sensors 320 and 330 and the turbidity sensors 310 and 330 of the water tank 32, and analyzes them to read the water level change and the turbidity change (S115).

The rotary mop controller 160 changes the waveform of the output current of the drive motor 38 to reflect the water supply operation and the contamination of the water tank 32 according to the analyzed water level change and turbidity change, and transmits it to the controller 150 (S116).

The controller 150 receives the output current of the drive motor 38 received according to each period, and analyzes it to determine the current water supply operation and whether the water tank 32 are contaminated (S117).

If the output current read out is a water supply error, or if it indicates contamination of the water tank 32, the controller 150 alarms the water supply error of the robot cleaner 100 or the contamination of the water tank 32 as the application of the user terminal 3 (S118). The alarm may include both sound and display information, and may be periodically alarmed.

The controller 150 receives the alarm confirmation information from the user terminal 3 (S119), and stops the operation of the water spraying of the nozzle by stopping the operation of the pump 34, it is possible to stop travelling or return to the station (S120).

As described above, the detection signals of each sensor are periodically received from the rotary mop controller 160 that controls the drive motor 38 and reflected in the output current value of the drive motor 38, thereby it can alarm for errors for contaminating the current water tank and supplying water.

Figure 8:
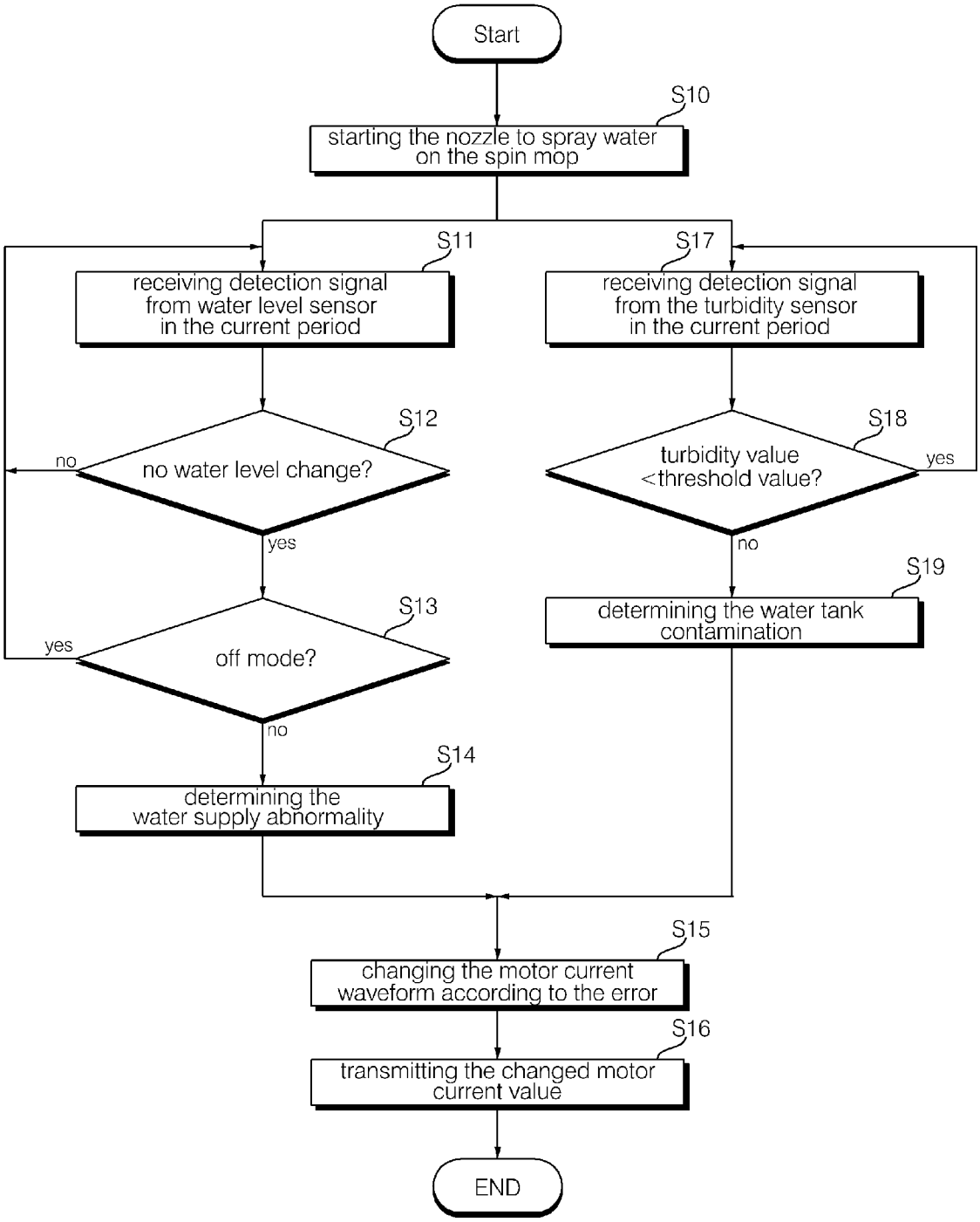
FIG. 8 is a flow chart showing a control method of a rotary mop controller of the robot cleaner according to an embodiment of the present disclosure.

The robot system according to the present embodiment may have a configuration as shown in FIG. 1, and when the robot cleaner 100 performing the operation as shown in FIG. 8 exists in the robot system, the robot system 100 interlocks with the server 2 and the user terminal 3 and the output current value of the drive motor 38 may be used to provide the alarm for water supply errors and contamination to the user.

At this time, the alarm about the water supply error and contamination may be periodically in the form of flicker to draw the user's attention.

The application of the user terminal 3 can induce a command for the next operation of the robot cleaner 100 to the user along with the alarm for water supply error and contamination.

In the next operation, dry mop cleaning or stop cleaning can be activated by being iconified.

When the dry mop cleaning is selected, the robot cleaner 100 stops the operation of the pump 34 and stops spraying water from the nozzle, and while maintaining the rotation of the spin mop, it is possible to perform the dry mop cleaning, which can attach dust and the like in the state of the dry mop.

Meanwhile, when the cleaning stop icon of the user terminal 3 is selected, the robot cleaner 100 stops both the operation of the pump 34 and the operation of the drive motor 38, thereby spraying water and rotating the spin mop are stopped. Accordingly, the robot cleaner 100 stops at the current position with the operation stopped.

At this time, when the icon of stop cleaning is selected according to the setting, it be able to be set to return to the charging station 200 while rotating the spin mop in the state of stopping the water spray.

When the alarm for the water supply error and contamination is displayed, the user selects the above operation and transmits the selection information to the robot cleaner 100.

The robot cleaner 100 receiving the selection information reads the selection information and performs the operation according to the read information.

That is, when the dry mop cleaning is selected as described above, the spin mop maintains rotation, but the water spray of the nozzle may be stopped to proceed with the dry mop cleaning.

The alarm may include both sound and display information and may be periodically alarmed.

At this time, the controller 150 may stop the spraying of the nozzle by stopping the operation of the pump 34 and stop travelling or return to the charging station 200.

Figure 9:
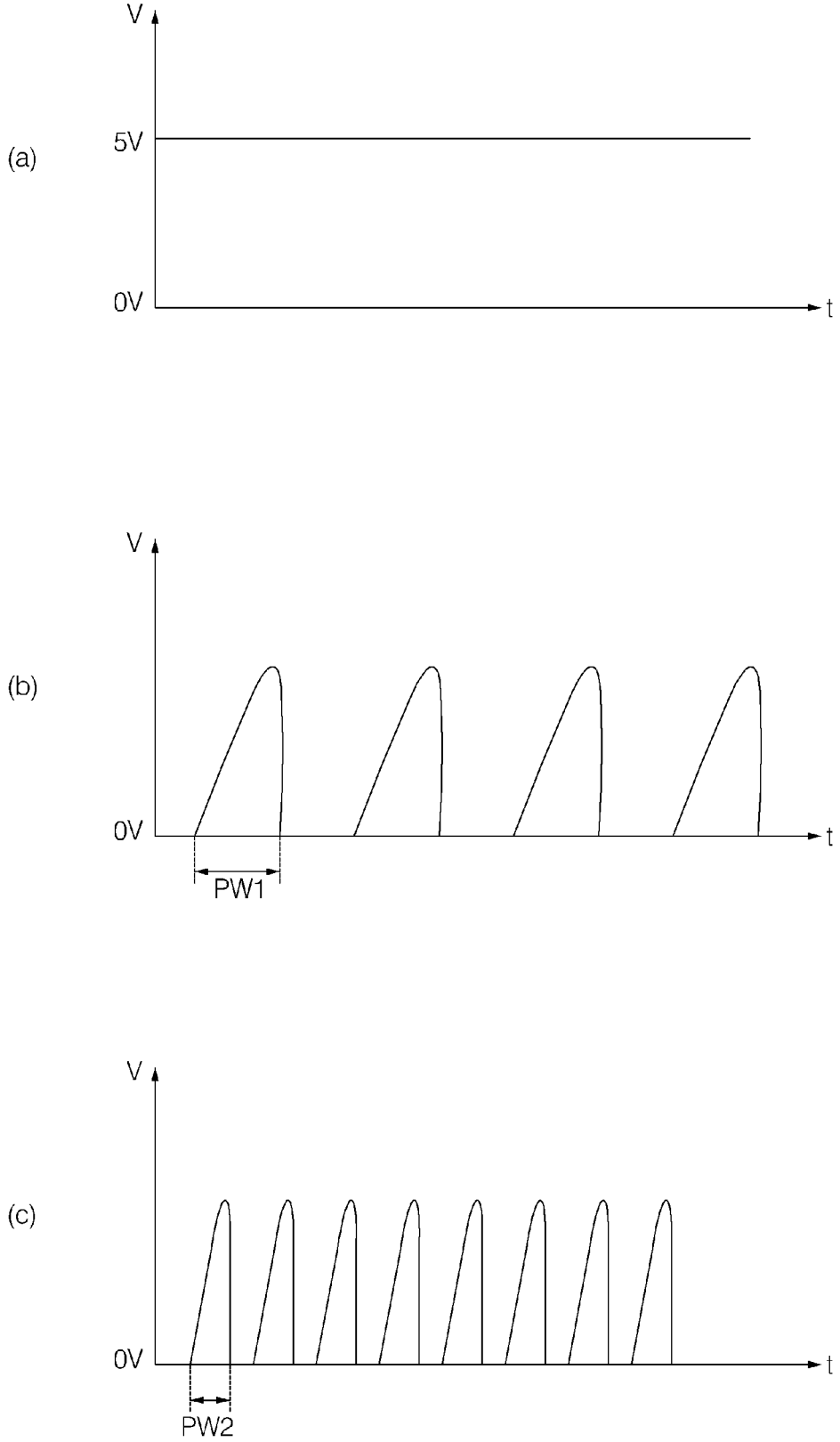
FIG. 9 is a graph showing the output current value of FIG. 8.
Figure 10:
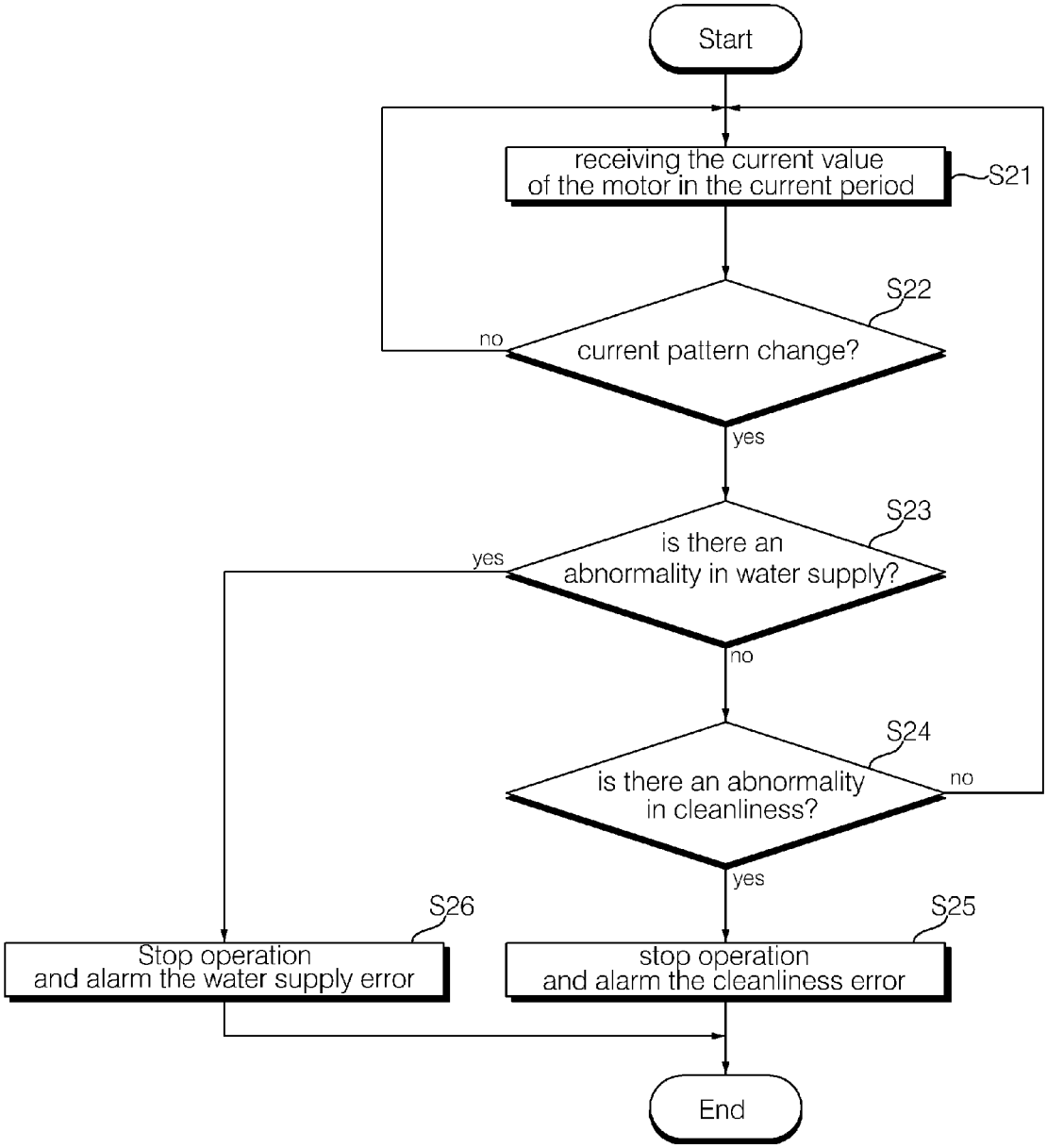
FIG. 10 is a flow chart showing a control method of the controller of the robot cleaner continuous with FIG. 9.

FIG. 8 is a flow chart showing a control method of the rotary mop controller 160 of the robot cleaner 100 according to an embodiment of the present disclosure, FIG. 9 is a graph showing the output current value of FIG. 8, and FIG. 10 is a flowchart illustrating a control method of the controller 150 of the robot cleaner 100 continuous with FIG. 8.

First, referring to FIG. 8, the rotary mop controller 160 drives the pump 34 and the nozzle to supply water to the rotary mop 80 according to a start signal from the controller 150 (S10).

At this time, the rotary mop controller 160 periodically reads the detection signal from the turbidity sensor and the water level sensor arranged in the water tank 32 (S11, S17).

When analyzing the detection signal read from the current period, it is determined that the operation is abnormal when the water level of the current period is compared with the water level of the previous period from the detection signal of the water level sensors 320 and 330 as shown in FIG. 8 and there is no change (S12).

At this time, the rotary mop controller 160 determines whether the power of the pump 34 or the nozzle is in the off state, that is, it is the dry mop cleaning mode, and determines that there is an abnormality in water supply when the mode is not (S13).

When there is the abnormality in the water supply, it indicates that there is an abnormality in the pump 34 or the nozzle as a whole. In general, it may also indicate whether water is insufficient in the water tank 32.

Meanwhile, when analyzing the detection signal read in the current period, the rotary mop controller 160 determines whether the turbidity value of the water supplied in the current period is smaller than the threshold value from the detection signals of the turbidity sensors 310 and 330 (S18).

That is, the threshold of the turbidity value indicates a contaminated state that cannot be cleaned with the water when the turbidity of the water in the water tank 32 corresponds to the threshold value, and when the turbidity value is greater than or equal to the threshold value, it is determined that the water in the water tank 32 is contaminated as the abnormality in cleanliness (S19).

At this time, the rotary mop controller 160 changes the waveform of the output current of the motor 38 according to the determination result (S15).

The changed period may be set to a predetermined value and may be maintained only while being transmitted to the controller 150 in the corresponding period.

At this time, the changes of the output current of the rotary mop controller 160 may be as shown in FIG. 9.

For example, in the normal operation without errors, the output current of the drive motor 38 may represent a continuous waveform as shown in FIG. 9*a* in which a current of a predetermined value is continuously output rather than pulse width control.

The absolute value of the output current may represent a maximum value that can indicate whether the motor 38 is constrained.

At this time, when it is determined that there is an abnormality in the water supply according to the determination result of the rotary mop controller 160, as shown in FIG. 9*b*, it is outputted by changing to a pulse signal having a first width.

In this case, the first width pw1 may satisfy a pulse width of 50 to 70% but it is not limited thereto.

Meanwhile, if it is determined that the turbidity of the water tank 32 is abnormal according to the determination result of the rotary mop controller 160, it is output by changing to the pulse signal having a second width pw2 as shown in FIG. 9*c*.

At this time, the second width pw2 is different from the first width pw1, and may have a pulse width smaller than the first width pw1.

For example, the second width pw2 is smaller than the first width pw1 and may satisfy a pulse width of 20 to 30% of the first width pw1.

The rotary mop controller 160 changes the output current of the drive motor 38 according to the determination result in the current period, outputs it to the controller 150, terminates the operation of the period, and detects the detection signal in the next period repeatedly (S16).

Meanwhile, the controller 150 obtains the changed output current of the drive motor 38 in the corresponding period from the rotary mop controller 160 as shown in FIG. 10 (S21).

At this time, the output current value is analyzed to determine whether there is a change in the current pattern (S22).

That is, it is determined whether the data for the current pattern stored in the storage unit 130, that is, whether it is a pulse width waveform and whether the pulse width is the first width pw1 or the second width pw2.

At this time, when the pulse width is determined to be the first width pw1, it is determined that the water supply is abnormal, and an alarm is performed to the user terminal 3 and the server 2 as to whether the water supply is abnormal (S26).

Meanwhile, if the pulse width is determined to be the second width pw2 (S24), the cleanliness is abnormal, that is, it is determined that contamination of the water tank 32 occurs, the operation is terminated, and an alarm is performed to the user terminal 3 and the server 2 as for the abnormality in cleanliness (S25).

As described above, after installing the simple sensor in the water tank 32, the rotary mop controller 160 can change the current waveform according to the detection signal of the sensor and transmit the result to the main controller 150, so that it is possible to solve the disadvantage in wet cleaning by performing determining on the water tank contamination and water supply error only with the output current value of the drive motor 38 without separate signal determination module and the signal transmission module.

Some embodiments of the present disclosure are equipped with a variety of simple sensors in the water tank. Based on signals from these sensors, it is possible to detect water supply abnormality and water turbidity of the water tank providing water to the rotary mops. In addition, by controlling the output current of the motor of the rotary mop of the robot cleaner without a separate sensing signal processing module, a detection result for the sensors of the water tank can be provided to the user, thereby reducing cost and operation.

In the above, preferred embodiments of the present disclosure have been illustrated and described, but the present disclosure is not limited to the above-described specific embodiments, and the technical field to which the present disclosure pertains without departing from the gist of the present disclosure claimed in the claims. Of course, various modifications can be made by those skilled in the art, and these modifications should not be individually understood from the technical idea or prospect of the present disclosure.

What is claimed is:

1. A robot cleaner comprising:

a main body;

a water tank including a plurality of sensors including a turbidity sensor and a water level sensor, the water tank configured to contain water;

a pair of rotary mops configured to move the main body while rotating in contact with a floor;

a drive motor configured to rotate the pair of rotary mops;

a nozzle configured to supply water from the water tank to the rotary mops;

a rotary mop controller configured to control the nozzle and the drive motor, and vary an output current of the drive motor based on detection signals from the sensors; and a controller configured to determine whether the water tank is contaminated based on the output current of the drive motor received from the rotary mop controller.

2. The robot cleaner of claim 1, the turbidity sensor is positioned on a wall surface of the water tank, the turbidity sensor being configured to detect a turbidity of the water in the water tank.

3. The robot cleaner of claim 1, wherein the water level sensor is positioned on a wall surface of the water tank, the water level sensor being configured to detect a water level of the water in the water tank.

4. The robot cleaner of claim 1, wherein the rotary mop controller is configured to periodically receive the detection signals from the turbidity sensor and the water level sensor and change the output current of the drive motor based on the received detection signals.

5. The robot cleaner of claim 1, wherein the rotary mop controller is configured to determine that the water supply is abnormal and change the output current of the drive motor to a first value when a detection signal from the water level sensor does not change compared to a detection signal from a previous period.

6. The robot cleaner of claim 5, wherein the rotary mop controller is configured to determine that the water in the water tank is contaminated and change the output current of the drive motor to a second value when a detection signal from the turbidity sensor is greater than or equal to a threshold value.

7. The robot cleaner of claim 6, wherein the first value and the second value are different from each other.

8. The robot cleaner of claim 6, wherein the first value and the second value have different pulse widths.

9. The robot cleaner of claim 1, wherein the controller is configured to periodically receive the output current of the drive motor from the rotary mop controller and analyze a waveform of the received output current to determine whether the water supply is abnormal or the water tank is contaminated.

10. The robot cleaner of claim 1, wherein the turbidity sensor includes a transmitter and a receiver disposed on an outer wall of the water tank, and wherein the receiver is configured detect a turbidity of water in the water tank based on an ultrasonic signal from the transmitter.

11. The robot cleaner of claim 10, wherein the water level sensor includes a light emitter and a light receiver on the outer wall of the water tank, and wherein the light receiver faces the light emitter.

12. The robot cleaner of claim 11, wherein the receiver of the turbidity sensor and the light receiver of the water level sensor form one module and the one module is configured to output a detection signal to the rotary mop controller.

13. A robot system comprising:

a robot cleaner configured to perform wet cleaning in a cleaning area;

a server configured to communicate with and control the robot cleaner; and a user terminal configured to perform control of the robot cleaner using an application for interworking with the robot cleaner and the server, wherein the robot cleaner comprises:

a main body;

a water tank including a plurality of sensors including a turbidity sensor and a water level sensor, the water tank configured to contain water;

a pair of rotary mops configured to move the main body while rotating in contact with a floor;

a drive motor configured to rotate the pair of rotary mops;

a nozzle configured to supply water of the water tank to the pair of rotary mops;

a rotary mop controller configured to control the nozzle and the drive motor, and vary an output current of the drive motor based on detection signals from the plurality of sensors of the water tank; and a controller configured to determine whether the water tank is contaminated based on the output current of the drive motor received from the rotary mop controller.

14. The robot system of claim 13, wherein the turbidity sensor is positioned on a wall surface of the water tank, the turbidity sensor being configured to detect a turbidity of the water in the water tank, and wherein the water level sensor is configured to detect a water level of the water in the water tank.

15. The robot system of claim 13, wherein the rotary mop controller is configured to periodically receive detection signals from the turbidity sensor and the water level sensor and change the output current of the drive motor based on the received detection signals.

16. The robot system of claim 13, wherein the rotary mop controller is configured to determine that a water supply is abnormal and change the output current of the drive motor to a first value when a detection signal from the water level sensor does not change compared to a detection signal from a previous period, and wherein the rotary mop controller is configured to determine that the water in the water tank is contaminated and change the output current of the drive motor to a second value when a detection signal from the turbidity sensor is greater than or equal to a threshold value.

17. The robot system of claim 16, wherein the first value and the second value have different pulse widths.

18. The robot system of claim 13, wherein the controller is configured to (i) periodically receive the output current of the drive motor from the rotary mop controller, (ii) analyze a waveform of the received output current to determine whether the water supply is abnormal or the water tank is contaminated, and (iii) transmit a determined result to the user terminal.

19. The robot system of claim 13, wherein the turbidity sensor includes a transmitter and a receiver on an outer wall of the water tank, and wherein the receiver is configured to detect a turbidity of water in the water tank based on an ultrasonic signal from the transmitter.

20. The robot system of claim 13, wherein the water level sensor includes a light emitter and a light receiver on an outer wall of the water tank, the light receiver facing the light emitter.

* * * * *